US008243092B1

(12) United States Patent
Bavoil

(10) Patent No.: US 8,243,092 B1
(45) Date of Patent: Aug. 14, 2012

(54) SYSTEM, METHOD, AND COMPUTER PROGRAM PRODUCT FOR APPROXIMATING A PIXEL COLOR BASED ON AN AVERAGE COLOR VALUE AND A NUMBER OF FRAGMENTS

(75) Inventor: Louis F. Bavoil, London (GB)

(73) Assignee: NVIDIA Corporation, Santa Clara, CA (US)

( * ) Notice: Subject to any disclaimer, the term of this patent is extended or adjusted under 35 U.S.C. 154(b) by 950 days.

(21) Appl. No.: 11/933,714

(22) Filed: Nov. 1, 2007

(51) Int. Cl.
*G09G 5/00* (2006.01)
*G09G 5/02* (2006.01)

(52) U.S. Cl. ..... 345/592; 345/581; 345/589

(58) Field of Classification Search ..... 345/592, 345/589, 581
See application file for complete search history.

(56) References Cited

U.S. PATENT DOCUMENTS 5,386,509 A * 1/1995 Suzuki et al. ..... 345/501
5,974,198 A * 10/1999 Hamburg et al. ..... 382/284
7,064,771 B1 * 6/2006 Jouppi et al. ..... 345/614
2002/0080141 A1 * 6/2002 Imai et al. ..... 345/519
2002/0126138 A1 * 9/2002 Shekter ..... 345/660
2003/0025700 A1 * 2/2003 Sasaki et al. ..... 345/531
2004/0179020 A1 * 9/2004 Lewis et al. ..... 345/582
2004/0217974 A1 * 11/2004 Lewis ..... 345/611

OTHER PUBLICATIONS

Everitt, "Interactive Order-Independent Transparency," Technical Report, NVIDIA Corporation, 2001.
Meshkin, "Sort-Independent Alpha Blending," Perpetual Entertainment, Game Developers Conference, Mar. 2007.
James et al., "Real-Time Animated Translucency," NVIDIA Corporation, Game Developers Conference, 2004.
Lokovic et al., "Deep Shadow Maps," Proc. SIGGRAPH 2000, Aug. 2000.
Liu et al., "Multi-Layer Depth Peeling via Fragment Sort," MSR-TR-2006-81, Microsoft Research, Jun. 2006.
Bavoil et al., "Multi-Fragment Effects on the GPU using the k-Buffer," I3D 2007.
U.S. Appl. No. 11/799,142.
Mammen, "Transparency and Antialiasing Algorithms Implemented with the Virtual Pixel Maps Technique," IEEE Computer Graphics & Applications, Jul. 1989.
U.S. Appl. No. 11/945,223, filed Nov. 26, 2007.

* cited by examiner

*Primary Examiner* — Jeffrey Chow
(74) *Attorney, Agent, or Firm* — Zilka-Kotab, PC

(57) ABSTRACT

A system, method, and computer program product are provided for approximating a pixel color. In operation, an average color value and a number of fragments are identified for each of a plurality of pixels. Additionally, a color of each pixel is approximated, based on such average color value and number of fragments.

21 Claims, 5 Drawing Sheets

300

| PIXEL (308) | ALPHA (302) | COLOR (304) | # OF FRAGMENTS (306) |
|---|---|---|---|
| PIXEL 1 | $A_1$ | $(R \cdot A)_1$, $(B \cdot A)_1$, $(G \cdot A)_1$ | $n_1$ |
| PIXEL 2 | $A_2$ | $(R \cdot A)_2$, $(B \cdot A)_2$, $(G \cdot A)_2$ | $n_2$ |
| --- | --- | --- | --- |
| --- | --- | --- | --- |
| --- | --- | --- | --- |

FIGURE 3

SYSTEM, METHOD, AND COMPUTER PROGRAM PRODUCT FOR APPROXIMATING A PIXEL COLOR BASED ON AN AVERAGE COLOR VALUE AND A NUMBER OF FRAGMENTS

FIELD OF THE INVENTION

The present invention relates to graphics processing, and more particularly to graphics processing involving transparent or semi-transparent objects.

BACKGROUND

Alpha blending refers to a process of combining rasterized fragments with a background to create the appearance of partial transparency. Rendering semi-transparent surfaces correctly using an alpha blending equation typically requires sorting fragments from front-to-back or back-to-front.

In real-time applications, this is often performed by sorting primitives using a central processing unit or using depth peeling on a graphics processor. Such depth peeling requires a separate geometry pass for each transparency layer. Unfortunately, this can be quite resource intensive.

For applications that only need a transparency "look and feel," techniques have been developed for approximating the result of correct depth-sorted alpha blending. One such approximation technique involves a sum of color that is weighted with an alpha value or transparency coefficient. While such techniques are less resource intensive, the resultant quality is less than desired.

There is thus a need for addressing these and/or other issues associated with the prior art.

SUMMARY

A system, method, and computer program product are provided for approximating a pixel color. In operation, an average color value and a number of fragments are identified for each of a plurality of pixels. Additionally, a color of each pixel is approximated, based on such average color value and number of fragments.

BRIEF DESCRIPTION OF THE DRAWINGS

FIG. 3 shows a data structure for approximating a pixel color, in accordance with one embodiment.

DETAILED DESCRIPTION

Figure 1:
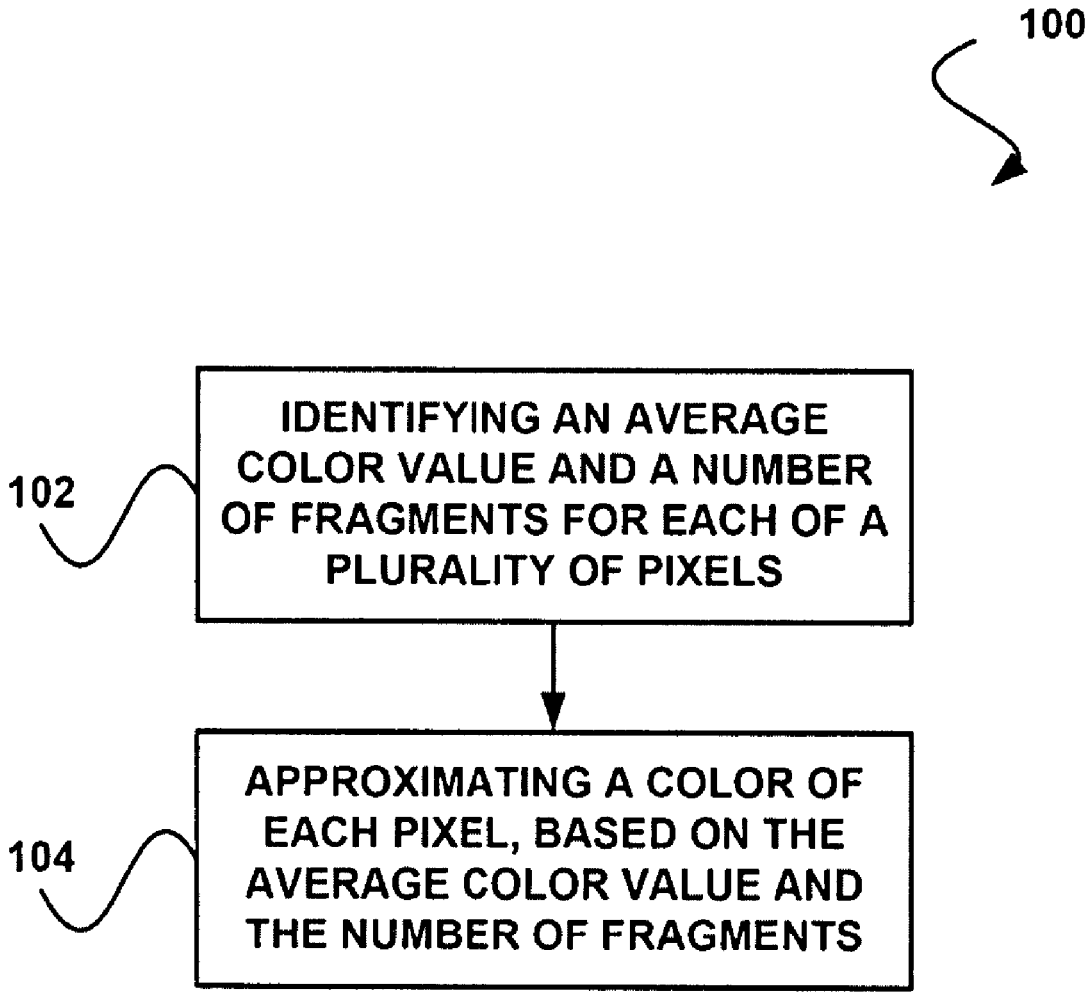
FIG. 1 shows a method for approximating a pixel color, in accordance with one embodiment.

FIG. 1 shows a method 100 for approximating a pixel color, in accordance with one embodiment. As shown, an average color value and a number of fragments are identified for each of a plurality of pixels. See operation 102.

In the context of the present description, fragments refer to a primitive or portion of a primitive corresponding to a pixel. Such primitives may include points, lines, or triangles. In one embodiment, the number of fragments may include a number of primitives that overlap with a corresponding pixel.

Strictly as an option, the average color value may be a weighted color value. In this case, the average color value may be weighted with an alpha value (i.e. a transparency coefficient), a depth value, a distance value, and/or any other weighting value. To this end, a color of each pixel is approximated, based on the average color value and the number of fragments. See operation 104. In various other embodiments, the color of each pixel may be approximated based on additional criteria. For example, the color of each pixel may be approximated based on an alpha value, a background color value, a depth value of a fragment, a distance value from a first fragment to a second fragment for each of the plurality of pixels, and/or various other various factors. Of course, these factors are only examples and should not be construed as limiting.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
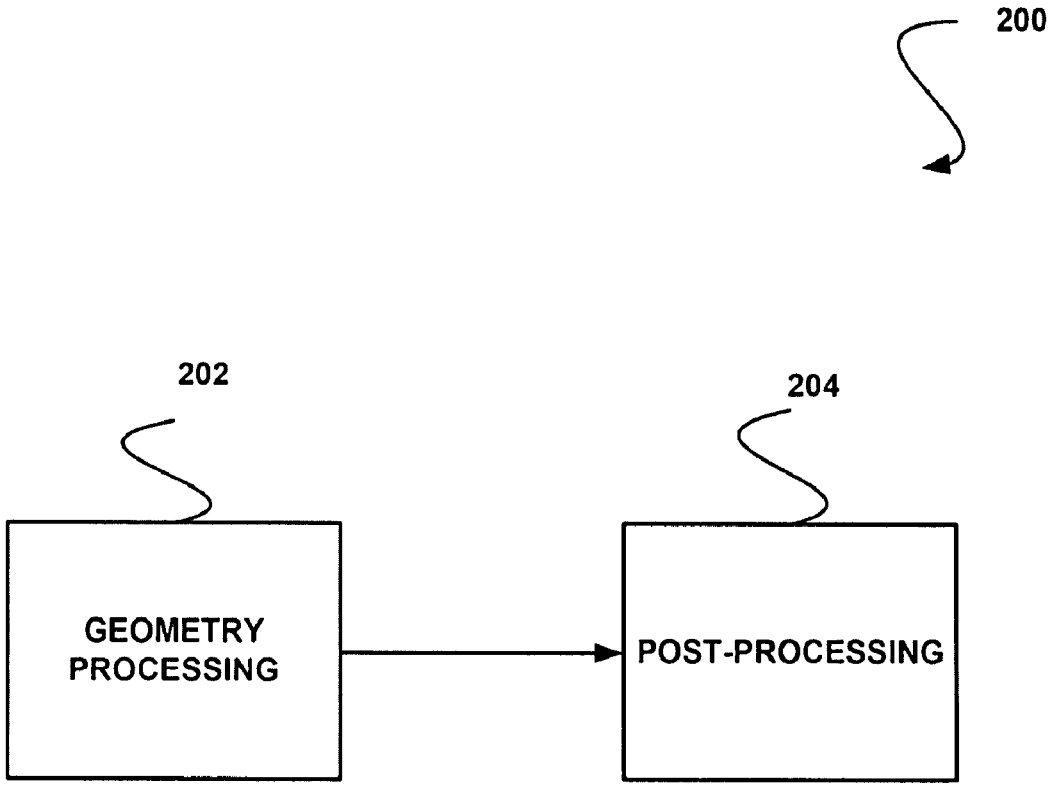
FIG. 2 shows a system for approximating a pixel color, in accordance with one embodiment.

FIG. 2 shows a system 200 for approximating a pixel color, in accordance with one embodiment. As an option, the present system 200 may be implemented to carry out the method 100 of FIG. 1. Of course, however, the system 200 may be implemented in any desired environment. It should also be noted that the aforementioned definitions may apply during the present description.

As shown, a geometry processing module 202 and a post-processing module 204 are provided. In operation, the geometry processing module 202 accumulates data in a buffer for each of a plurality of pixels. For example, the geometry processing module 202 may accumulate color values (e.g. a red value, a blue value, a green value, etc.), an alpha value, a number of fragments per pixel (e.g. depth complexity, etc.), and/or various other data for each pixel.

In one embodiment, a color value and a number of fragments may be stored for each pixel in the accumulation buffer, during at least one geometry pass. The geometry processing module 202 may accumulate this data for all primitives in a scene. The contents of the accumulation buffer may then be processed during a post-processing pass using the post-processing module 204.

During such post-processing pass, the contents of the accumulation buffer may be utilized to compute an average color, an average alpha value, and an approximate color for each pixel. For example, a red, green, and blue value (RGB value), and an alpha value (A) for each fragment may be utilized to compute a weighted average color (C) for each pixel using Equation #1.

$$C=\Sigma[(RGB)A]/\Sigma A. \qquad \text{Equation \#1}$$

Of course, it should be noted that the foregoing equation is set forth for illustrative purposes only and should not be construed as limiting in any manner whatsoever.

Additionally, the average alpha value (A) for each pixel may be computed from the accumulated data using the alpha value (A) for each fragment and the total number of fragments (n) from each pixel using Equation #2.

$$A=\Sigma A/n. \qquad \text{Equation \#2}$$

Again, it should be noted that the foregoing equation is set forth for illustrative purposes only and should not be construed as limiting in any manner whatsoever.

In one embodiment, the weighted sum of the RGB value (e.g. Σ[(RGB) A]) and the sum of the alpha values (ΣA) may be stored in the buffer such that the computation of the average weighted color (C) only involves one step of division. For example, as part of the geometry pass, the color value (RGB) for each fragment may be multiplied by the alpha value (A) for each fragment, and this result may be stored and added to results from additional fragments corresponding to the pixel. Similarly, the alpha value may be stored for each of the fragments corresponding to the pixel in an additive manner, resulting in a value which is the sum of all alpha values for fragments corresponding to a pixel. Of course, such implementation is optional and should not be construed as limiting in any manner.

Once the average alpha value and average color for each pixel is obtained, a destination color for each pixel ($C_{dst}$) may be approximated using Equation #3.

$$C_{dst}=C(1-(1-A)^n)+C_{bg}(1-A)^n \qquad \text{Equation \#3}$$

In Equation #3, C is the weighted average color for each pixel, A is the average alpha value for each pixel, $C_{bg}$ is the background color value, and n is the number of fragments per pixel. Thus, the blended color for each pixel ($C_{dst}$) is a function of C, A, n, and the background color $C_{bg}$.

Although the present example utilizes the weighted average color for each pixel, in another embodiment, the average color for each pixel may also be used without weighting. Furthermore, the average color for a pixel may be calculated in a variety of ways using a variety of weighting coefficients. Weighting the average color using the alpha value is only one example and should not be construed as limiting in any manner.

FIG. 3 shows a data structure 300 for approximating a pixel color, in accordance with one embodiment. As an option, the data structure 300 may be implemented in the context of the functionality and architecture of FIGS. 1-2. Of course, however, the data structure 300 may be implemented in any desired environment. It should also be noted that the aforementioned definitions may apply during the present description.

As shown, the data structure 300 stores alpha values 302, color values 304, and a number of fragments 306 for a plurality of pixels 308. It should be noted that, although the data structure 300 is illustrated as including the plurality of pixels 308, in another embodiment, an index corresponding to the data structure 300 may be utilized to determine the pixel. For example, the plurality of pixels 308 may represent a 2-dimensional pixel coordinate in an image. Thus, a pixel coordinate may be determined utilizing an index corresponding to the data structure 300.

In one embodiment, one geometry pass may serve to accumulate and store the alpha values 302, the color values 304, and the number of fragments 306 for each of the pixels 308. For example, for every fragment of "Pixel 1," the alpha value for such fragment may be added to a total alpha value "$A_1$" for Pixel 1. Additionally, for every fragment of Pixel 1, a weighted red, green, and blue value may be accumulated and stored. In one embodiment, the red, green, and blue value may be weighted using the alpha value for the fragment. For example, the red, green, and blue value for each fragment of Pixel 1 may be multiplied by the corresponding alpha value for each fragment, and the result may be stored and accumulated in the data structure 300.

Further, the number of fragments 306 is incremented and stored. For example, for each fragment corresponding to a pixel, a fragment count may increment by one. The alpha values 302, the color values 304, and the number of fragments 306 for each of the pixels 308 may then be used in a post-processing operation to calculate an approximate color for each of the pixels 308.

It should be noted that, in other embodiments, the data structure 300 may include various other data corresponding to the pixels 308 and/or the corresponding fragments. For example, in one embodiment, depth information for a particular fragment may be stored. In another embodiment, the depth information may be used to weight the color values 304. Such weighting may occur in addition to, or instead of, the alpha value weighting.

Similarly, depth information for a particular fragment may be stored. For example, the depth of a fragment from a top layer or another fragment of a pixel may be stored. As an option, the depth information may be used to weight the colors 304. Such weighting may occur in addition to, or instead of, the alpha value weighting and/or any depth weighting.

Figure 4:
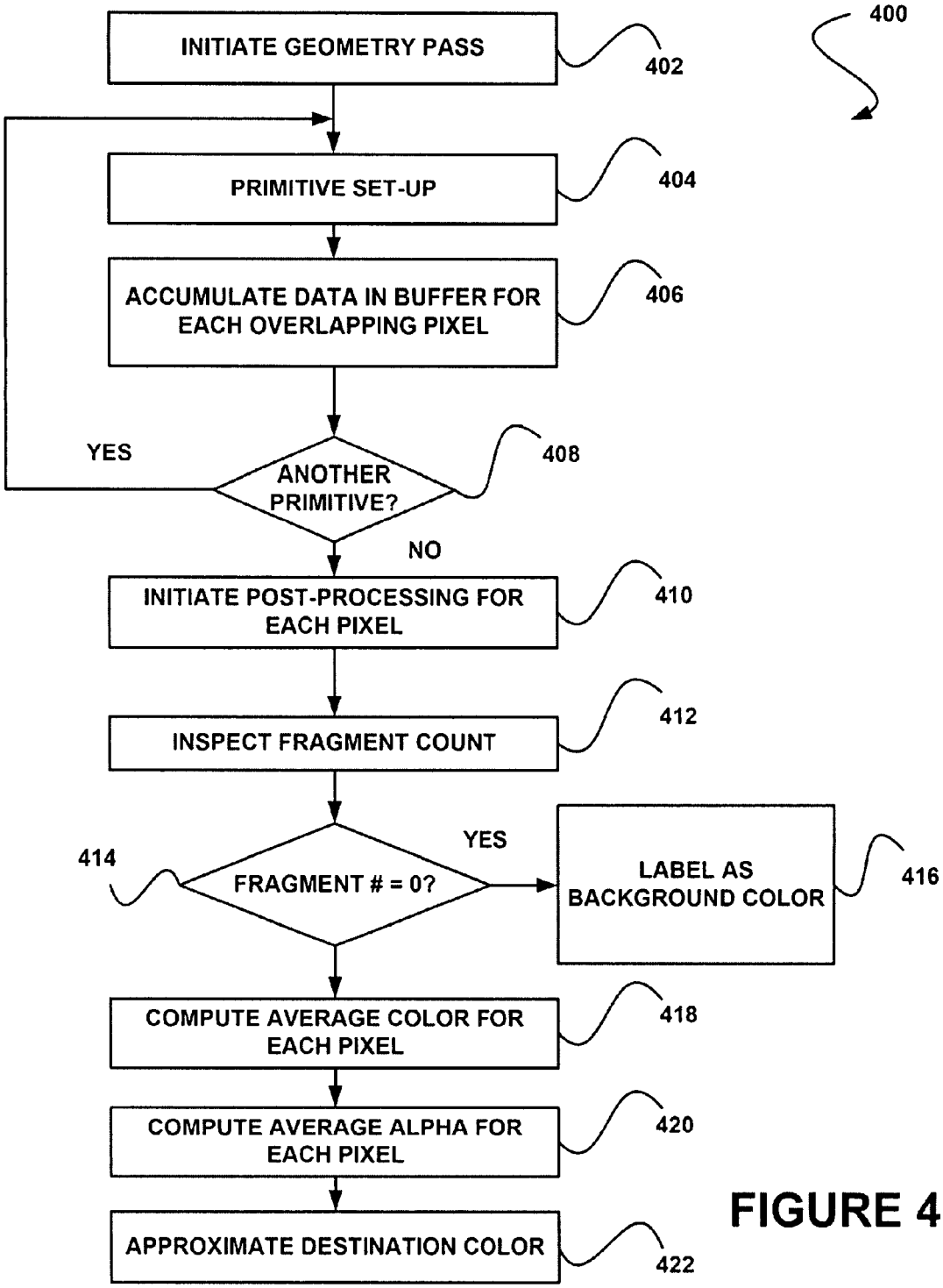
FIG. 4 shows a method for approximating a pixel color, in accordance with another embodiment.

FIG. 4 shows a method 400 for approximating a pixel color, in accordance with another embodiment. As an option, the present method 400 may be implemented in the context of the functionality and architecture of FIGS. 1-3. Of course, however, the method 400 may be carried out in any desired environment. Again, the aforementioned definitions may apply during the present description.

As shown, a geometry pass is initiated. See operation 402. After the initiation of the geometry pass, the method 400 selects a next primitive in a primitive stream, and sets up a graphics processor for the next operation (e.g. rasterization, accumulation, etc.). See operation 404.

Once the primitive is selected, data is accumulated in a buffer for each overlapping pixel. See operation 406. In various embodiments, the data may include a color value for each overlapping pixel (e.g. a red value, a blue value, a green value, etc.), a transparency coefficient (e.g. an alpha value, etc.), a depth complexity (e.g. a number of fragments per pixel, etc.), and/or any other data corresponding to each pixel.

For example, an alpha value may be identified for each of the pixels. In this case, the alpha values may be stored in an accumulation buffer. Similarly, the color values and the number of fragments for each pixel may be stored in such accumulation buffer.

In one embodiment, the accumulation may include rendering geometry corresponding to overlapping pixels into an accumulation buffer implemented as a 16-bit floating-point texture. In the context of the present description, an overlapping pixel refers to a pixel corresponding to (e.g. covered by) at least one primitive. In one embodiment, an overlapping pixel may include data from portions of multiple primitives in a layered format. In this case, a number of fragments, color values, and/or transparency coefficients may be accumulated for each layer. Additionally, changes may be implemented in post-processing in order to blend multiple layers together.

Once the data has been accumulated for each overlapping pixel of the primitive, it is determined whether another primitive is available. See decision 408. If there is another primitive, the next primitive is selected and data for each overlapping pixel of the primitive is accumulated in the buffer.

As shown, these operations may repeat until all desired primitives have been selected. Once it is determined that no more primitives are available, post-processing is initiated for each pixel. See operation 410.

Once post-processing is initiated for each pixel, a fragment count (e.g. number of fragments for a pixel, etc.) is inspected. See operation 412. In this case, the fragment count may be a number stored in the accumulation buffer which indicates a total number of fragments corresponding to a pixel. Upon inspection of the fragment count, it is determined whether the fragment count is equal to zero. See decision 414.

If it is determined that the fragment count is equal to zero, the pixel is labeled as a background color. See operation 416. In this case, a fragment count of zero may indicate that the pixel has no corresponding fragments. Thus, a color associated with such pixel may be set or labeled as a background color. It should be noted that the background color may include an actual scene background, as well as an object or image background.

If it is determined that the fragment count is not equal to zero, an average color is computed for each pixel. See operation 418. Additionally, an average alpha value, or transparency coefficient, is computed for each pixel. See operation 420.

As an option, the average color value may be a weighted color value. In one embodiment, the average color value may be weighted with the alpha value. For example, the average color may be computed using Equation #1.

In another embodiment, the average color value may be weighted with a depth value. For example, the average color may be computed using Equation #4.

$$C=\Sigma[(RGB)D]/\Sigma D, \qquad \text{Equation \#4}$$

In Equation #4, D indicates the depth value for a fragment. In this case, the RGB value for each fragment may be weighted based on a relative depth or a number of fragments from the surface.

In still another embodiment, the average color value may be weighted with a distance value. For example, the RGB value for each fragment may be weighted using the distance of the fragment from a first layer or fragment of the pixel. In this case, a larger distance from the top layer may correspond to a smaller weighted color value.

Using the average alpha value and the average color for each pixel, a destination color is approximated. See operation 422. As an option, the destination color may be approximated using Equation #3.

Figure 5:
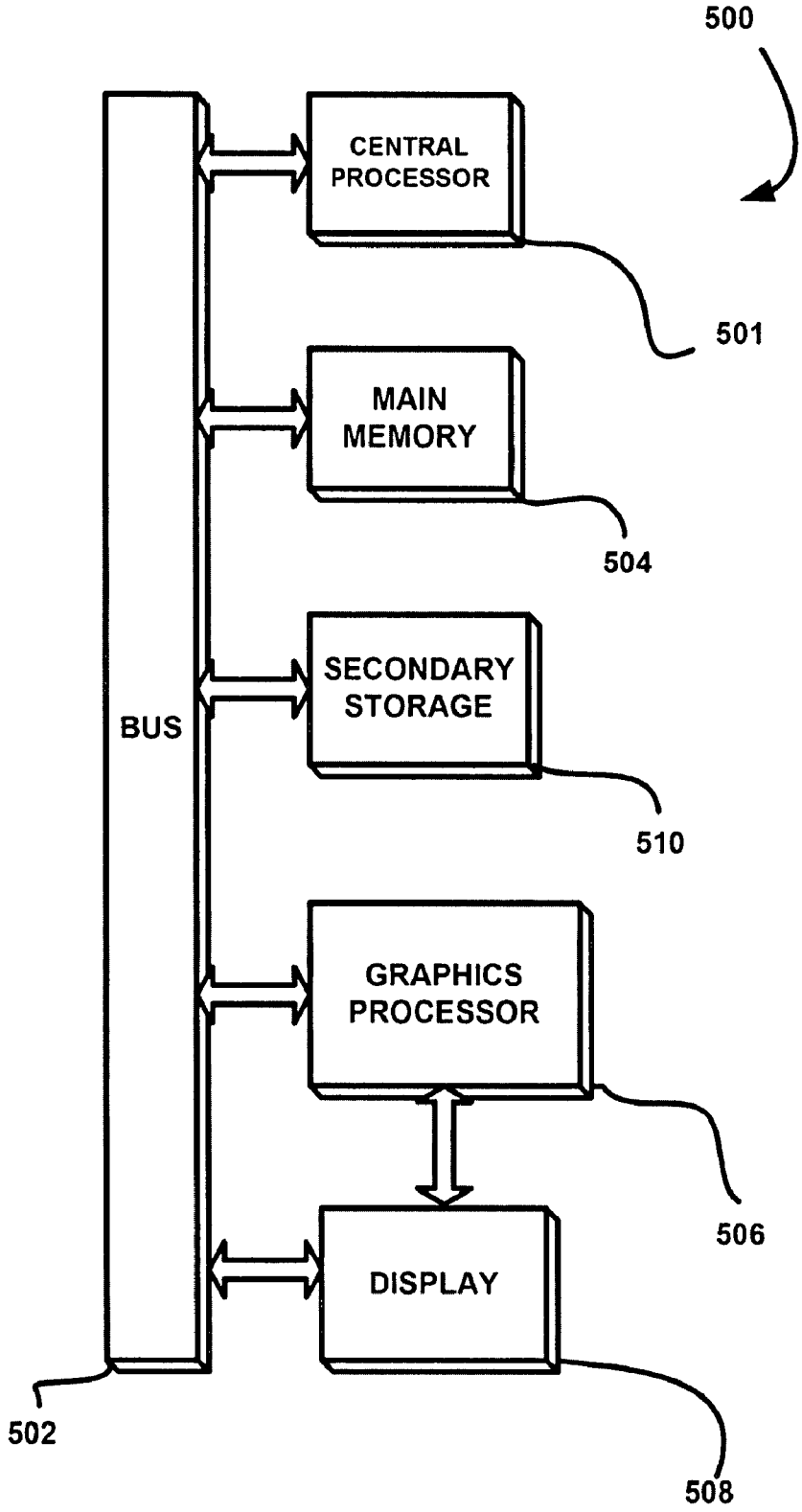
FIG. 5 illustrates an exemplary system in which the various architecture and/or functionality of the various previous embodiments may be implemented.

FIG. 5 illustrates an exemplary system 500 in which the various architecture and/or functionality of the various previous embodiments may be implemented. As shown, a system 500 is provided including at least one host processor 501 which is connected to a communication bus 502. The system 500 also includes a main memory 504. Control logic (software) and data are stored in the main memory 504 which may take the form of random access memory (RAM).

The system 500 also includes a graphics processor 506 and a display 508, i.e. a computer monitor. In one embodiment, the graphics processor 506 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

Computer programs, or computer control logic algorithms, may be stored in the main memory 504 and/or a secondary storage 510. Such computer programs, when executed, enable the system 500 to perform various functions. Memory 504, storage 510 and/or any other storage are possible examples of computer-readable media.

In one embodiment, the architecture and/or functionality of the various previous figures may be implemented in the context of the host processor 501, graphics processor 506, an integrated circuit (not shown) that is capable of at least a portion of the capabilities of both the host processor 501 and the graphics processor 506, a chipset (i.e. a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 500 may take the form of a desktop computer, lap-top computer, and/or any other type of logic. Still yet, the system 500 may take the form of various other devices including, but not limited to, a personal digital assistant (PDA) device, a mobile phone device, a television, etc.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

for each of a plurality of pixels:

calculating an average color value;

calculating a number of fragments, wherein the number of fragments includes a total count of the number of fragments;

calculating an average alpha value, wherein the average alpha value includes an average of each alpha fragment value of each said fragment, and wherein the average alpha value includes a transparency coefficient; and approximating a color, utilizing a processor, based on the average color value, the total count of the number of fragments, and the average alpha value.

2. The method of claim 1, wherein the average color value is a weighted color value.

3. The method of claim 2, wherein the average color value is weighted with an alpha value.

4. The method of claim 2, wherein the average color value is weighted with a depth value.

5. The method of claim 2, wherein the average color value is weighted with a distance value from a first fragment to a second fragment.

6. The method of claim 1, wherein the number of fragments includes a number of primitives that overlap with a corresponding pixel.

7. The method of claim 1, wherein a plurality of color values used to calculate the average color value are stored in an accumulation buffer.

8. The method of claim 1, wherein the number of fragments are stored utilizing an accumulation buffer.

9. The method of claim 1, wherein a plurality of color values and the number of fragments are stored in an accumulation buffer during at least one geometry pass.

10. The method of claim 9, wherein contents of the accumulation buffer are processed during a post-processing pass.

11. The method of claim 10, wherein the average color value is calculated during the post-processing pass.

12. The method of claim 10, wherein during the post-processing pass, the number of fragments per pixel is inspected.

13. The method of claim 12, wherein if one of the plurality of pixels is determined to have a number of fragments equal to zero, the pixel is labeled as a background color.

14. The method of claim 1, wherein the color of each pixel is approximated, based on a background color value.

15. The method of claim 1, wherein the average color value is calculated using $\Sigma[(RGB)\ A]/\Sigma A$, where RGB is a red, a green, and a blue value and A is the alpha fragment value of each said number of said fragments.

16. The method of claim 1, wherein the average alpha value is calculated using $\Sigma A/n$, where A is the alpha fragment value of each said number of said fragments and n is the total count of the number of fragments per pixel.

17. A computer program product embodied on a non-transitory computer readable medium, comprising:

for each of a plurality of pixels:

computer code for calculating an average color value;

computer code for calculating a number of fragments, wherein the number of fragments includes a total count of the number of fragments;

computer code for calculating an average alpha value, wherein the average alpha value includes an average of each alpha fragment value of each said fragment, and wherein the alpha value includes a transparency coefficient; and computer code for approximating a color, based on the average color value, the total count of the number of fragments, and the average alpha value.

18. An apparatus, comprising:

a processor for approximating a color of each of a plurality of pixels;

wherein the processor for each of said pixels:

calculates an average color value;

calculates a number of fragments, wherein the number of fragments includes a total count of the number of fragments;

calculates an average alpha value, wherein the average alpha value includes an average of each alpha fragment value of each said fragment, and wherein the average alpha value includes a transparency coefficient; and approximates a color based on the average color value, the total count of the number of fragments, and the average alpha value.

19. The apparatus of claim 18, wherein the processor remains in communication with memory and a display via a bus.

20. The apparatus of claim 18, wherein the processor includes a graphics processor.

21. The apparatus of claim 20, wherein the graphics processor is utilized to accumulate a plurality of color values and the number of fragments in an accumulation buffer.

* * * * *